US008109664B2

(12) United States Patent
Nakada

(10) Patent No.: US 8,109,664 B2
(45) Date of Patent: Feb. 7, 2012

(54) VEHICLE LIGHTING EQUIPMENT

(75) Inventor: Asami Nakada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 243 days.

(21) Appl. No.: 12/629,350

(22) Filed: Dec. 2, 2009

(65) Prior Publication Data

US 2010/0157616 A1 Jun. 24, 2010

(30) Foreign Application Priority Data

Dec. 22, 2008 (JP) ..... 2008-325589

(51) Int. Cl.
*F21S 8/10* (2006.01)
*F21V 21/00* (2006.01)

(52) U.S. Cl. ..... 362/545; 362/311.02; 362/511; 362/555

(58) Field of Classification Search ..... 362/311.02, 362/511, 545, 555
See application file for complete search history.

(56) References Cited

U.S. PATENT DOCUMENTS

| | | | | |
|---|---|---|---|---|
| 6,953,271 | B2 * | 10/2005 | Aynie et al. | 362/511 |
| 7,270,454 | B2 * | 9/2007 | Amano | 362/522 |
| 2006/0034094 | A1 * | 2/2006 | Asada et al. | 362/545 |

FOREIGN PATENT DOCUMENTS

JP 2008-146948 A 6/2008

* cited by examiner

*Primary Examiner* — Stephen F Husar
(74) *Attorney, Agent, or Firm* — Sughrue Mion, PLLC

(57) ABSTRACT

A vehicle lighting equipment is provided with: a light source in which a light emitting diode is employed; and a transparent lens on which a light emitted from the light source is incident and from which the incident light is emergent. The transparent lens includes: a center portion positioned to oppose the light source; and a light guiding portion positioned on an outer peripheral side of the center portion to guide the incident light to an inward area.

6 Claims, 12 Drawing Sheets

VEHICLE LIGHTING EQUIPMENT

BACKGROUND OF THE INVENTION

1. Field of the Invention

The present invention relates to a vehicle lighting equipment. More particularly, the present invention relates to a technical field in which a control surface for emitting a light at a predetermined angle is formed in a center portion of a transparent lens to prevent a glaring light, and the like.

2. Background Art

There is a vehicle lighting equipment of a type such that a light source using light emitting diodes (LEDs) and a transparent lens having a light guiding portion are arranged in an outer case consisting of an outer cover and a lamp housing and that a light emitted from the light source is emitted to the outside through the transparent lens (see JP-A-2008-146948, for example).

In the vehicle lighting equipment disclosed in JP-A-2008-146948, an incident portion from which a light being emitted from a light source is incident is formed on a transparent lens, and an emergent end surface from which the light incident from the incident portion and guided into the inside is emergent is also formed on the transparent lens. In the light that is emitted from the light source and then incident from the incident portion, a part of the light is transmitted through the incident portion and is emergent in an optical axis direction, and the remaining light is guided by a light guiding portion and is emergent from the emergent end surface.

However, in the vehicle lighting equipment disclosed in JP-A-2008-146948, the part of the light that is emitted from the light source and then incident from the incident portion is transmitted through the incident portion and is emergent in the optical axis direction. Therefore, it is feared that a location corresponding to a center portion of the transparent lens strongly shines like a spot and acts as a glaring light to an oncoming vehicle, a pedestrian, or the like.

In addition, in the vehicle lighting equipment, in order to ensure a good sign function and an illumination function, it is needed particularly that a desired illumination range should be ensured in the right and left direction and a desired illumination intensity should be ensured in this illumination range.

SUMMARY OF THE INVENTION

One or more embodiments of the invention provide a vehicle lighting equipment in which a glaring light can be prevented and a desired illumination range and a desired illumination intensity in the right and left directions can be ensured.

In accordance with one or more embodiments of the invention, a vehicle lighting equipment is provided with: a light source in which a light emitting diode is employed; and a transparent lens on which a light emitted from the light source is incident and from which the incident light is emergent. The transparent lens includes a center portion positioned to oppose to the light source and a light guiding portion positioned on an outer peripheral side of the center portion to guide the incident light to an inward area. The center portion includes an incident surface which opposes to the light source and on which the light emitted from the light source is incident, and a first emergent surface from which the light that is incident from the incident surface is emergent. The light guiding portion includes a second emergent surface from which the light guided to the inward area is emergent. The first emergent surface of the center portion includes a control surface adapted to control the light such that an emergent angle in a horizontal direction is set to a range of 25° to 50° with respect to an optical axis.

Therefore, in the vehicle lighting equipment, the light controlled by the control surface is emergent from the transparent lens at an emergent angle of 25° to 50° with respect to the optical axis in the horizontal direction.

Accordingly, a portion corresponding to the center portion of the transparent lens does not strongly shine like a spot, and such a situation can be prevented that the glaring light to an oncoming vehicle, a pedestrian, or the like is generated.

In addition, a desired illumination range can be ensured in the right and left direction, and also a desired illumination intensity can be ensured in this illumination range, so that the good sign function and illumination function can be ensured.

Further, a recessed portion may be formed on the center portion, and a surface constituting the recessed portion is formed as the control surface. Due to this structure, the control of the light can be carried out easily with a simple configuration.

Further, the recessed portion may be formed into a conical shape whose diameter is decreased toward a bottom portion. Due to this structure, even though the bottom portion has a slightly rounded shape depending on a machining precision, the slightly rounded portion is limited extremely small, and as a result the influence on the control of light can be suppressed to the minimum.

Further, the recessed portion may be formed such that respective widths of an opening surface in two directions that intersect orthogonally with the optical axis are different, and a bottom portion of the recessed portion is formed like a straight line that extends in a longitudinal direction of the opening surface. Due to this structure, a ratio between respective widths of the opening surface in two directions can be changed at need, and improvement in a margin of the control of light can be achieved.

Other aspects and advantages of the invention will be apparent from the following description, the drawings and the claims.

DETAILED DESCRIPTION OF THE EXEMPLARY EMBODIMENTS

An exemplary embodiment of a vehicle lighting equipment of the present invention will be explained with reference to the accompanying drawings.

In the exemplary embodiment, a vehicle lighting equipment of the present invention is applied to the vehicle lighting equipment called the so-called rear combination lamp that is equipped with respective functions of a turn signal lamp, a tail lamp, a stop lamp, etc. However, an applicability of the present invention is not limited to the rear combination lamp, and the present invention can be applied widely to a wide variety of vehicle lighting equipments in which the light emitting diode is employed as the light source.

Figure 1:
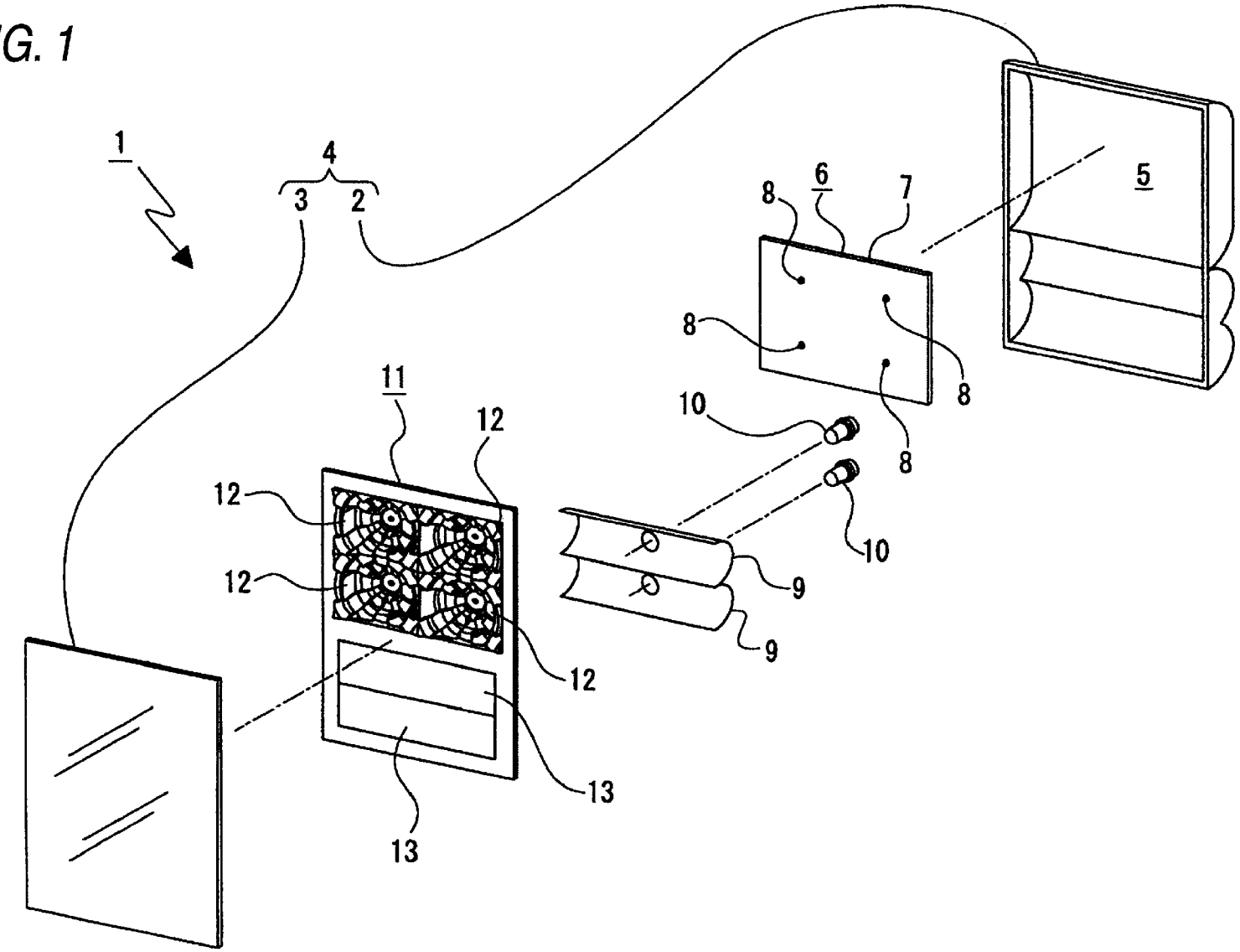
FIG. 1 is a schematic exploded perspective view of a vehicle lighting equipment according to an exemplary embodiment of the invention.

As shown in FIG. 1, a vehicle lighting equipment 1 is equipped with a lamp housing 2 having a concave portion that is opened in one direction, and an outer cover 3 for covering an opening surface of the lamp housing 2. An equipment outer case 4 is constructed by the lamp housing 2 and the outer cover 3, and an internal space in the equipment outer case 4 is formed as a lamp chamber 5.

A light emitting unit 6 is arranged in a position of the lamp chamber 5 on a side of the lamp housing 2. The light emitting unit 6 has a base plate 7, and a plurality of light sources 8, 8, . . . mounted on the base plate 7. As each of the light sources 8, a light emitting diode (LED) is employed. The light sources 8 are provided in four locations at a distance in the vertical and horizontal directions respectively.

The light sources 8, 8, . . . function as the tail lamp or the stop lamp in response to a lighting state.

Reflectors 9, 9 are arranged under the light emitting unit 6 to align vertically. Lamps 10 are respectively arranged in center portions of the reflectors 9, 9. For example, a halogen lamp is employed as each of the lamps 10.

The upper lamp 10 functions as the turn signal lamp, and the lower lamp 10 functions as the back signal lamp.

Figure 2:
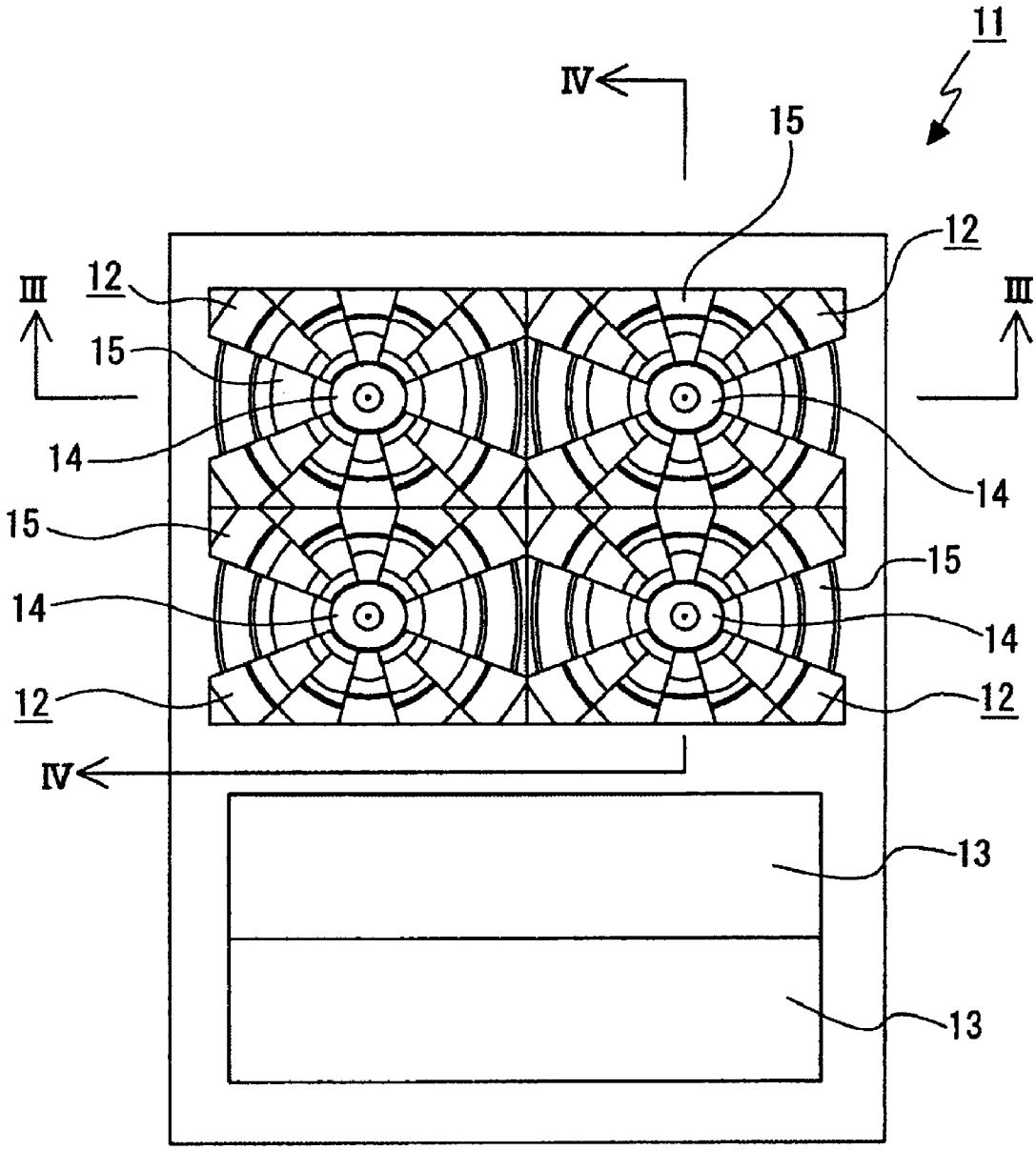
FIG. 2 is a rear view showing a lens body of the vehicle lighting equipment of FIG. 1.

A lens body 11 is arranged in a position opposing to the outer cover 3 in the lamp chamber 5 (see FIG. 1 and FIG. 2). An outer shape of the lens body 11 is shaped into a longitudinal rectangle, for example.

Four transparent lenses 12, 12, . . . aligned up and down and right and left, for example, are provided to an upper half portion of the lens body 11. Also, two inner lenses 13, 13 aligned up and down are provided to a lower half portion of the lens body 11.

Figure 3:
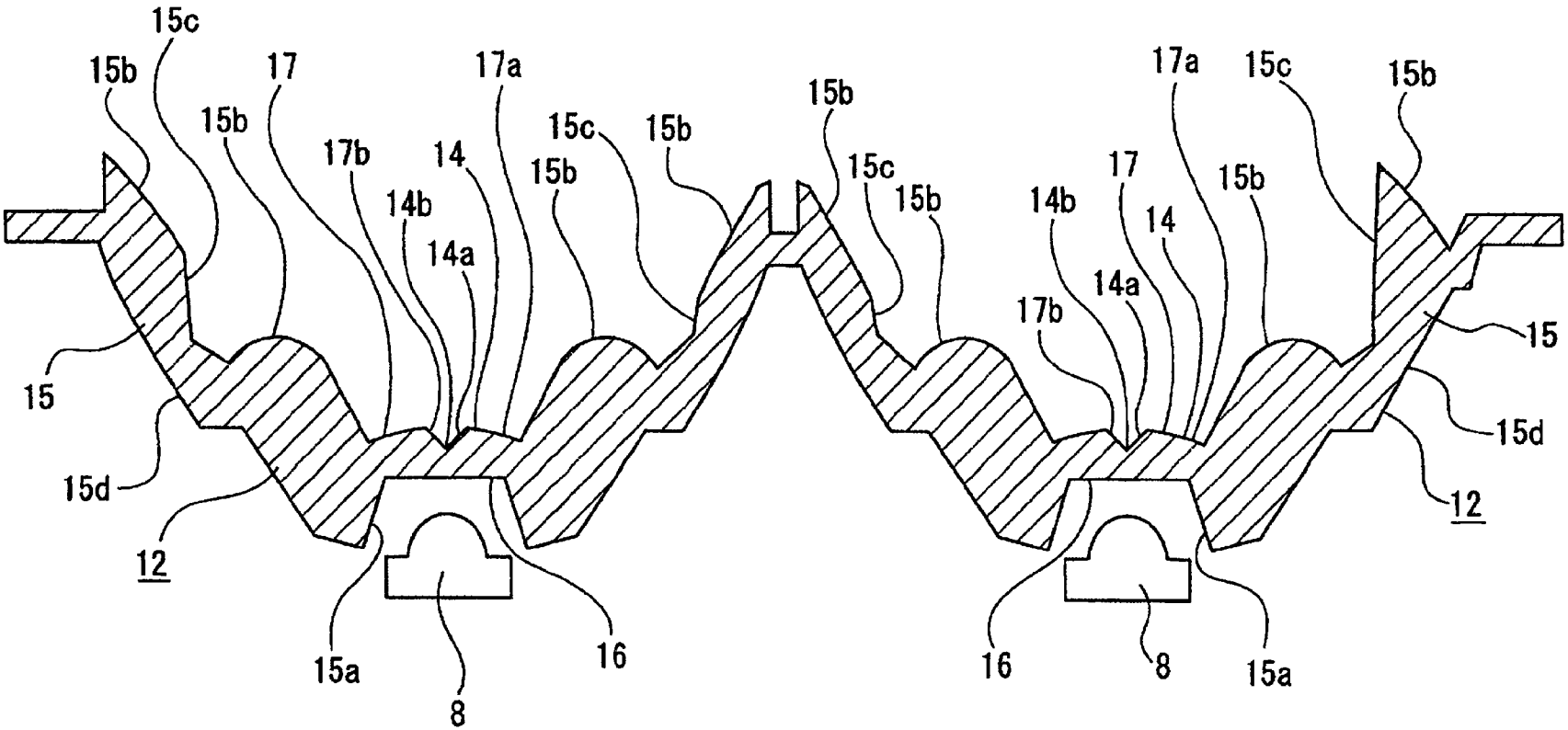
FIG. 3 is a sectional view taken along a line in FIG. 2.
Figure 4:
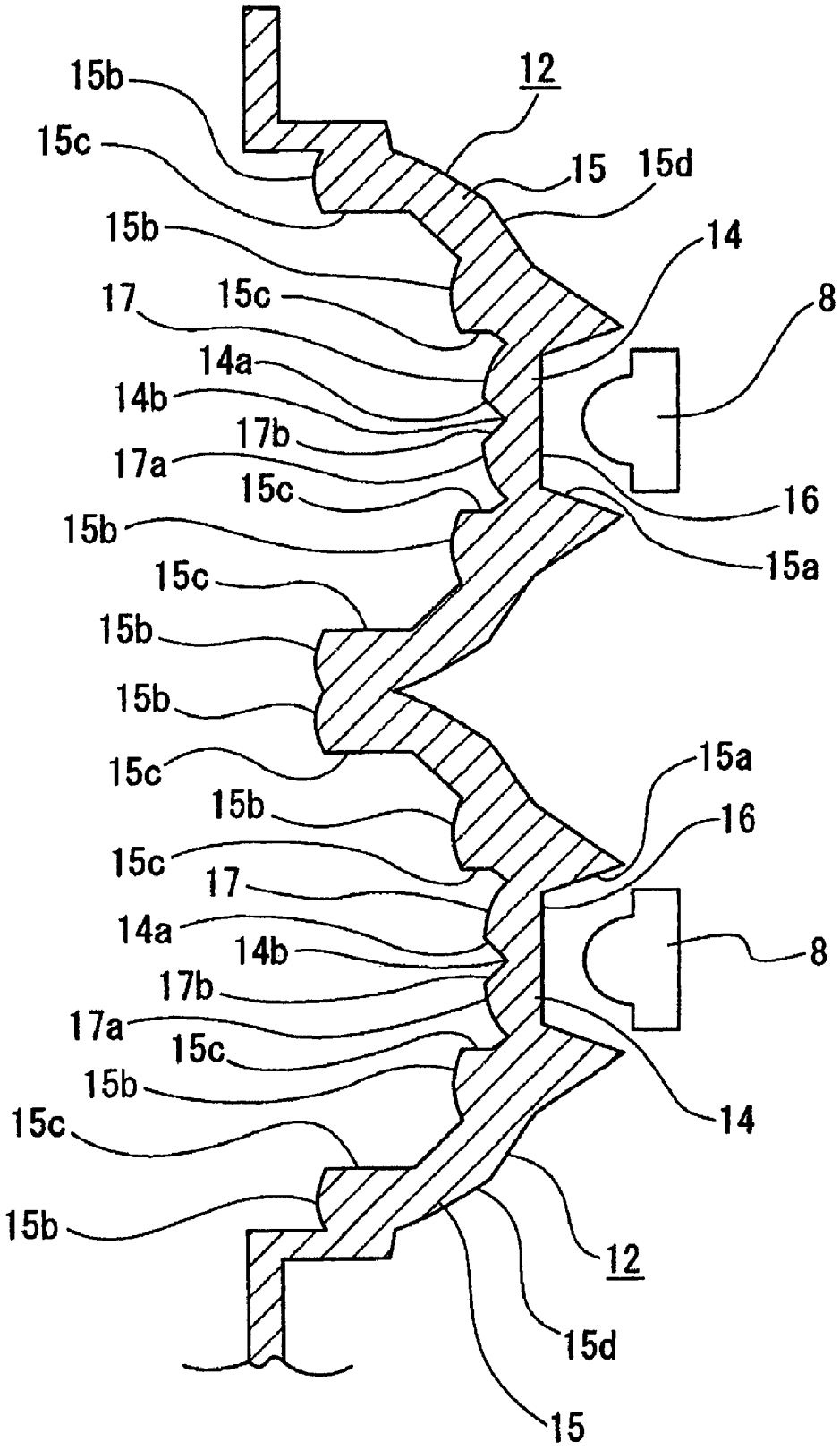
FIG. 4 is a sectional view taken along a IV-IV line in FIG. 2.

As shown in FIG. 3 and FIG. 4, each transparent lens 12 has a center portion 14 positioned to oppose to the each light source 8, and a light guiding portion 15 located on an outer peripheral side of the center portion 14. The light guiding portion 15 is formed so that such portion is displaced backward as it goes away from the center portion 14.

A surface of the center portion 14 opposing to the light source 8 is formed as an incident surface 16 that is directed forward. A surface of the center portion 14 located on an opposite side to the light source 8 beyond the incident surface 16 is formed as a first emergent surface 17. A front shape of the first emergent surface 17 is formed like a circular arc, and portions of the first emergent surface 17 except the center portion are shaped into a curved surface portion 17*a*.

A recessed portion 14*a* that is opened backward from the first emergent surface 17 is formed on the center portion 14. The recessed portion 14*a* is formed like a conical shape that is forwardly convex, a bottom portion 14*b* of the recessed portion 14*a* is formed as a vertex, and a surface of the center portion 14 constituting the recessed portion 14*a* is formed as a control surface 17*b*. The control surface 17*b*, when viewed as a longitudinal sectional shape, is formed like two V-shaped straight lines, for example.

A light guiding incident surface 15*a* is formed on the light guiding portion 15 in a position that continues to the incident surface 16 of the center portion 14. The light guiding incident surface 15*a* is formed such that this surface extends in the peripheral direction and is directed to the light source 8 side.

Second emergent surfaces 15*b*, 15*b*, from which the light guided by the light guiding portion 15 is emergent, and non-emergent surfaces 15*c*, 15*c*, . . . , from which the light guided by the light guiding portion 15 is not emergent, are formed in predetermined positions of the light guiding portion 15 respectively. An outer surface of the light guiding portion 15 is formed as a reflecting surface 15*d*, and the light is internally reflected by the reflecting surface 15*d*.

In the vehicle lighting equipment 1 constructed as above, when the light is emitted from the light source 8, a part of the emitted light is incident on the incident surface 16 of the transparent lens 12 and is emergent from the curved surface portion 17*a* or the control surface 17*b* of the first emergent surface 17.

Figure 5:
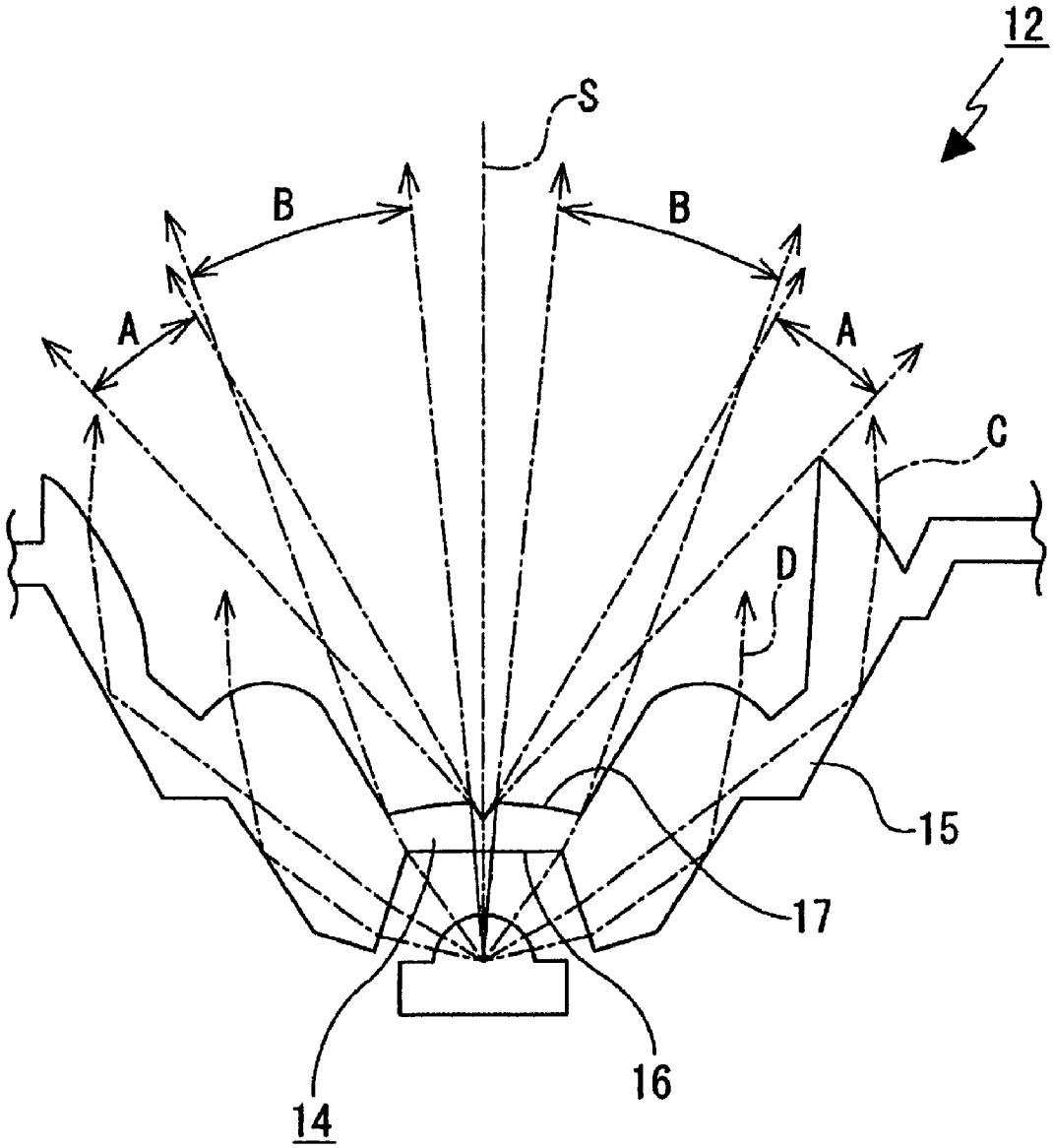
FIG. 5 is a conceptual view showing optical paths in a transparent lens.

As shown in FIG. 5, an emergent angle of the light that is emergent from the curved surface portion 17*a* is controlled by the control surface 17*b*. Thus, this light is emitted such that its emergent angle is set in a range of 25° to 50° from an optical axis S in the lateral direction. The light whose emergent angle is set in the range of 25° to 50° in the lateral direction arrives mainly at the portion of the light distributing area on the outer peripheral side in the lateral direction.

In FIG. 5, a range A is contained in such a range that the emergent angle is set in the range of 25° to 50°.

The light that is emergent from the curved surface portion 17*a* is emergent in the direction that is closer to the optical axis than the range A and is located in a range B that does not contain the optical axis direction. An emergent angle is from 5° to 25°, for example. In FIG. 5, the range B is contained in such a range that the emergent angle is set in the range of 5° to 25°.

In contrast, the light that is emitted from the light source 8 is also incident on the light guiding incident surface 15*a* of the light guiding portion 15. The light that is incident from the light guiding incident surface 15*a* is guided in the light guiding portion 15, then is internally reflected by the reflecting surface 15*d*, and then is emergent from the second emergent surfaces 15*b*, 15*b*, . . . (optical paths C, D shown in FIG. 5).

In the vehicle lighting equipment 1, the lights that are emergent from the lamps 10, 10 are reflected by the reflectors 9, 9 and are emergent via the inner lenses 13, 13 of the lens body 11 respectively.

As described above, in the vehicle lighting equipment 1, the first emergent surface 17 is formed on the center portion 14 of the transparent lens 12, and the control surface 17*b* for controlling the light in such a manner that the emergent angle in the lateral direction is set to 25° to 50° with respect to the optical axis S is formed on the control surface 17*b*.

As a result, the location corresponding to the center portion 14 of the transparent lens 12 never shines strongly like a spot, and such a situation can be prevented that the glaring light to an oncoming vehicle, a pedestrian, or the like is generated.

Also, the light whose emergent angle in the lateral direction is set to the range of 25° to 50° arrives mainly at the portion of the light distributing area on the outer peripheral side in the lateral direction. Therefore, a desired illumination range can be ensured in the right and left direction, and also a desired illumination intensity can be ensured in this illumination range, so that the good sign function and illumination function can be ensured.

Also, the recessed portion 14*a* is formed on the center portion 14 of the transparent lens 12, and the surface constituting the recessed portion 14*a* is formed as the control surface 17*b*. Therefore, the control of the light can be carried out easily with a simple configuration.

In addition, the recessed portion 14*a* is formed as a conical shape whose diameter is decreased toward the bottom portion 14*b*. Therefore, even though the bottom portion (vertex) 14*b* has a slightly rounded shape depending on a machining precision, the slightly rounded portion is limited extremely small, and as a result the influence on the control of light can be suppressed to the minimum.

Figure 6:
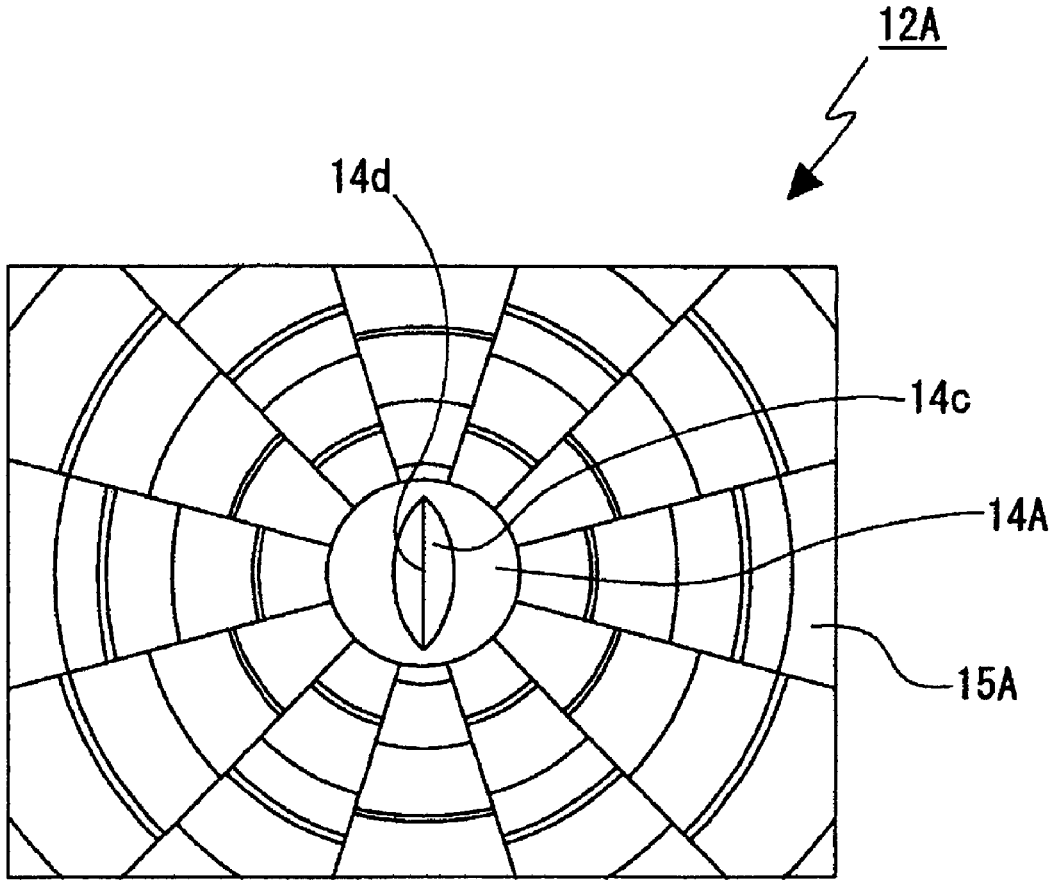
FIG. 6 is a rear view showing a variation of the transparent lens.
Figure 7:
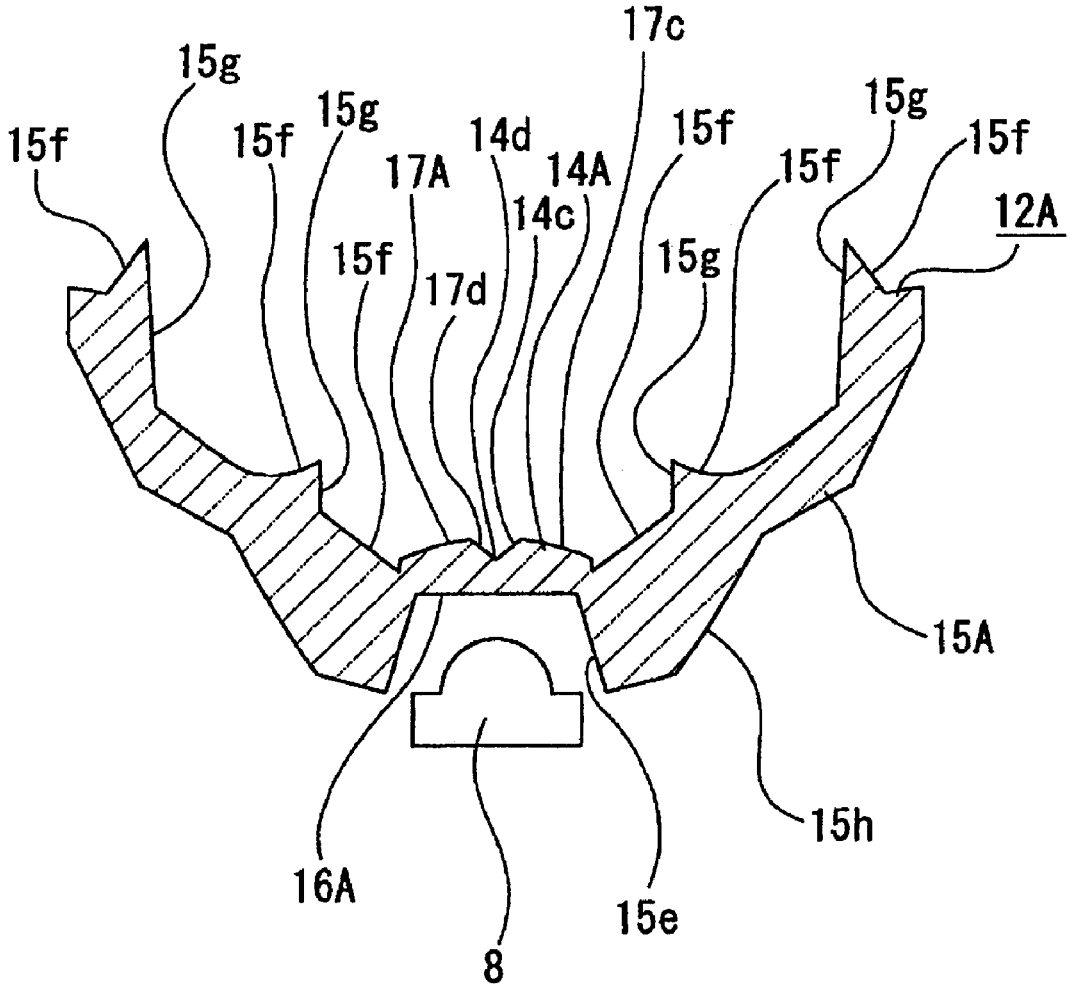
FIG. 7 is a sectional view showing the variation of the transparent lens of FIG. 6.
Figure 8:
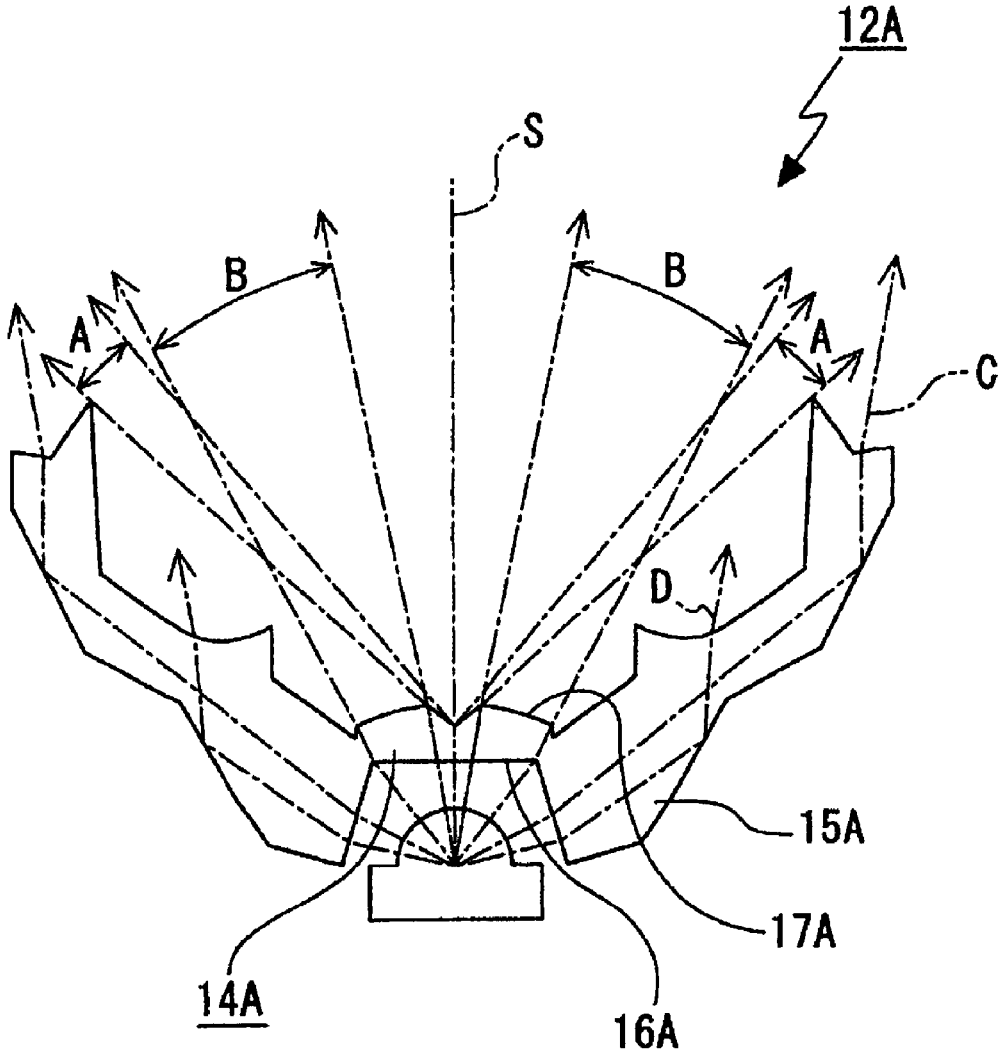
FIG. 8 is a conceptual view showing optical paths in the variation of the transparent lens of FIG. 6.

Next, a variation of the transparent lens is shown (see FIG. 6 to FIG. 8).

A transparent lens 12A according to a variation has a center portion 14A located to oppose to the light source 8, and a light guiding portion 15A positioned on the outer peripheral side of the center portion 14A. The light guiding portion 15A is formed such that this portion is displaced backward as it goes away from the center portion 14A.

A surface of the center portion 14A opposing to the light source 8 is formed as an incident surface 16A. A surface of the center portion 14A located on the opposite side to the light source 8 beyond the incident surface 16A is formed as a first emergent surface 17A. A front shape of the first emergent surface 17A is formed like a circular arc, and portions of the first emergent surface 17 except the center portion are shaped into a curved surface portion 17*c*.

A recessed portion 14c that is opened backward from the first emergent surface 17A is formed on the center portion 14A. An opening surface of the recessed portion 14*c* is formed into such a shape that a width in the vertical direction is set larger than a width in the horizontal direction, for example, and a bottom portion 14*d* of the recessed portion 14*c* is formed like a straight line that extends vertically. The width of the opening surface of the recessed portion 14*c* in the horizontal direction is maximized at a center in the vertical direction, and is formed such that the width is decreased gradually on both sides respectively as the location goes away from the center in the vertical direction. A surface of the center portion 14A constituting the recessed portion 14*c* is formed as a control surface 17*d*. The control surface 17*d*, when viewed as a longitudinal sectional shape, is formed like two V-shaped straight lines, for example.

A light guiding incident surface 15*e* is formed on the light guiding portion 15A in a position that continues to the incident surface 16A of the center portion 14A. The light guiding incident surface 15*e* is formed such that this surface extends in the peripheral direction and is directed to the light source 8 side.

Second emergent surfaces 15*f*, 15*f*, from which the light guided by the light guiding portion 15A is emergent, and non-emergent surfaces 15*g*, 15*g*, . . . , from which the light guided by the light guiding portion 15 is not emergent, are formed in predetermined positions of the light guiding portion 15A respectively. An outer surface of the light guiding portion 15A is formed as a reflecting surface 15*h*, and the light is internally reflected by the reflecting surface 15*h*.

When the light is emitted from the light source 8, a part of the emitted light is incident on the incident surface 16A of the transparent lens 12A and is emergent from the curved surface portion 17*c* or the control surface 17*d* of the first emergent surface 17A.

As shown in FIG. 8, an emergent angle of the light that is emergent from the curved surface portion 17*c* is controlled by the control surface 17*d*. Thus, this light is emitted such that its emergent angle is set in a range of 25° to 50° from the optical axis S in the lateral direction. The light whose emergent angle is set in the range of 25° to 50° in the lateral direction arrives mainly at the portion of the light distributing area on the outer peripheral side in the lateral direction. In FIG. 8, the range A is contained in such a range that the emergent angle is set in the range of 25° to 50°.

Also, the light that is emergent from the curved surface portion 17*c* is emergent in the direction that is closer to the optical axis than the range A and is located in the range B that does not contain the optical axis direction. An emergent angle is from 5° to 25°, for example. In FIG. 8, the range B is contained in such a range that the emergent angle is set in the range of 5° to 25°.

In contrast, the light that is emitted from the light source 8 is also incident on the light guiding incident surface 15*e* of the light guiding portion 15A. The light that is incident from the light guiding incident surface 15*e* is guided in the light guiding portion 15A, then is internally reflected by the reflecting surface 15*h*, and then is emergent from the second emergent surfaces 15*f*, 15*f*, . . . (optical paths C, D shown in FIG. 8).

As described above, the first emergent surface 17A is formed on the center portion 14A of the transparent lens 12A, and the control surface 17*d* for controlling the light in such a manner that the emergent angle in the lateral direction is set to 25° to 50° with respect to the optical axis S is formed on the control surface 17*b*. As a result, the location corresponding to the center portion 14A of the transparent lens 12A never shines strongly like a spot, and such a situation can be prevented that the glaring light to an oncoming vehicle, a pedestrian, or the like is generated.

Also, the light whose emergent angle in the lateral direction is set to the range of 25° to 50° arrives mainly at the portion of the light distributing area on the outer peripheral side in the lateral direction. Therefore, a desired illumination range can be ensured in the right and left direction, and also a desired illumination intensity can be ensured in this illumination range, so that the good sign function and illumination function can be ensured.

Also, the recessed portion 14*c* is formed on the center portion 14A of the transparent lens 12A, and the surface constituting the recessed portion 14*c* is formed as the control surface 17*d*. Therefore, the control of the light can be carried out easily with a simple configuration.

In addition, the opening surface of the recessed portion 14*c* is shaped such that a width in the vertical direction and a width in the horizontal direction are different, and the bottom portion 14*d* of the recessed portion 14*c* is formed like a straight line that extends in the longitudinal direction of the opening surface. Therefore, a ratio between the width of the opening surface in the vertical direction and the width in the horizontal direction can be changed at need, and improvement in a margin of the control of light can be achieved. As a result, a margin of the control of light can be improved in response to the necessary light distribution pattern, and an effect of preventing generation of the glaring light can be enhanced.

In the above, such an example is illustrated that, when viewed as a longitudinal sectional shape, the control surface 17*d* of the center portion 14A in the transparent lens 12A is shaped into the straight line. But the shape of the control surface 17*d* is not limited to the linear shape. For example, the control surface 17*d* may be shaped into a convex circular arc in the emergent direction of the light, as shown in FIG. 9, or the control surface 17*d* may be shaped into a concave circular arc in the emergent direction of the light, as shown in FIG. 10.

Figure 9:
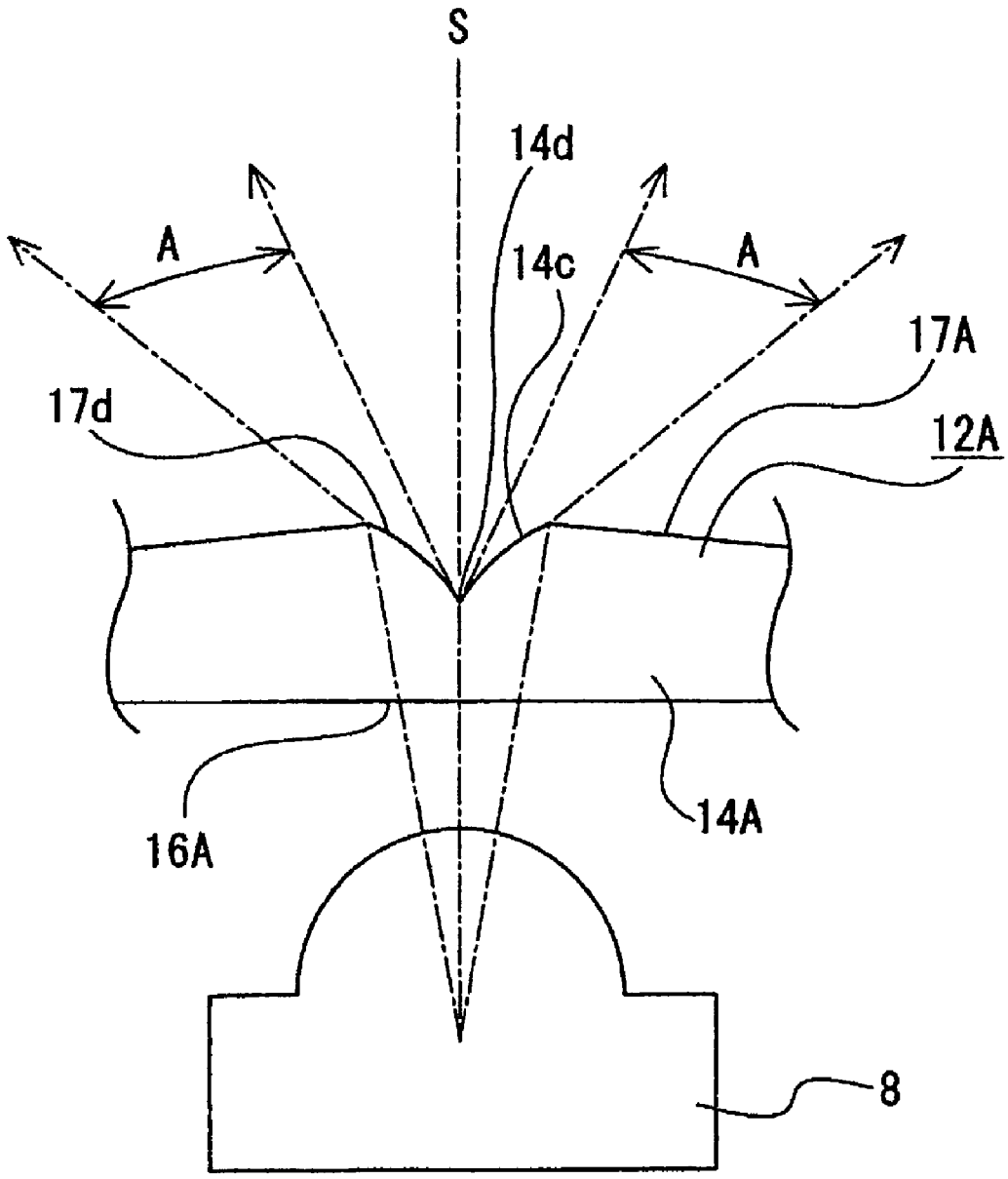
FIG. 9 is a conceptual view showing an example of a shape of a control surface.
Figure 10:
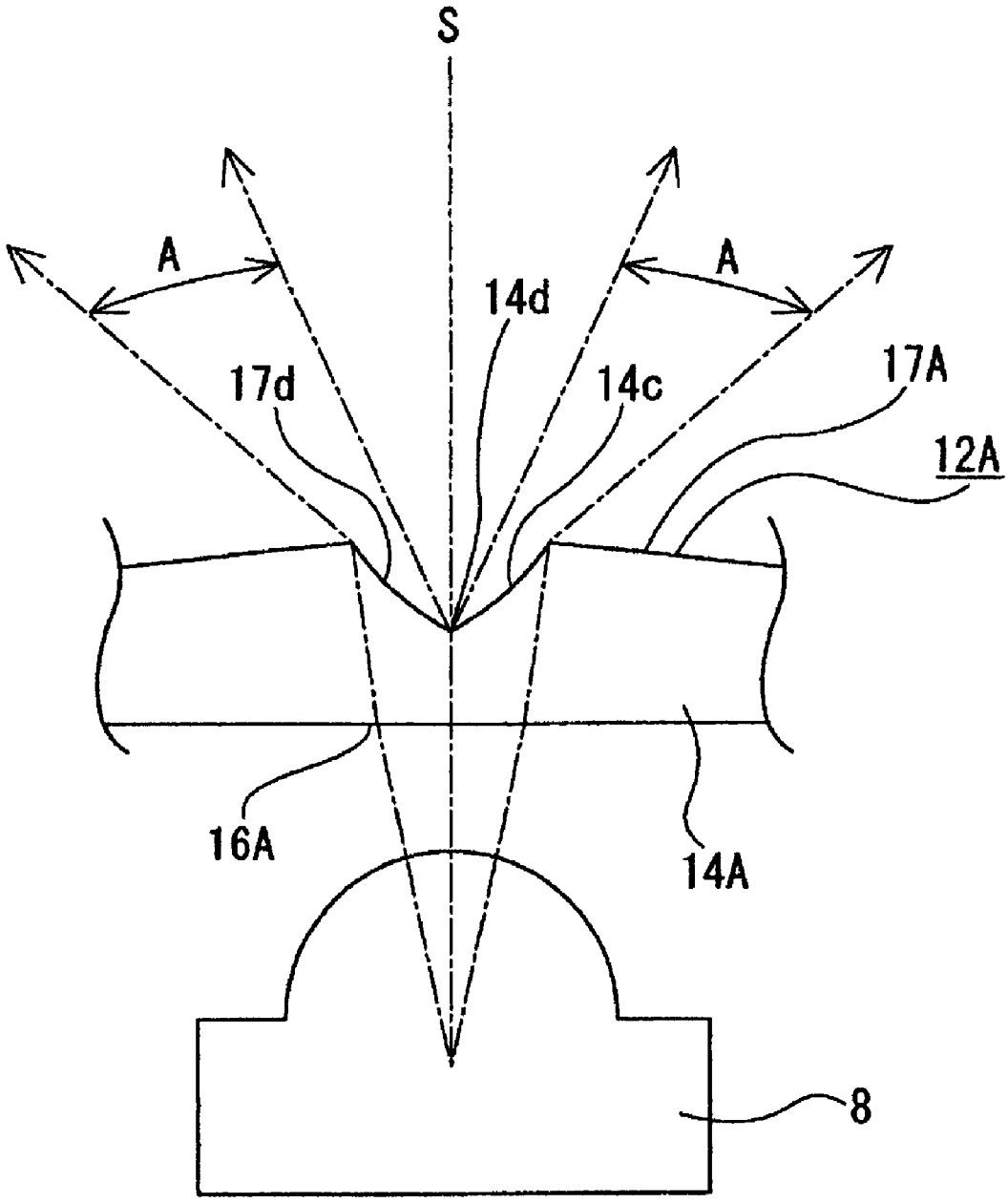
FIG. 10 is a conceptual view showing another example of the shape of the control surface.

When the shape of the control surface 17*d* is changed in this manner, the range A of the emergent angle in the lateral direction can be set to a desired ranged within the range of 25° to 50° with respect to the optical axis S, as shown in FIG. 9 and FIG. 10. Therefore, the shape of the control surface 17*d* can be set arbitrarily, and thus improvement in a margin of the control of light can be achieved.

In this case, the above change in the shape of the control surface is not limited to the control surface 17*d*. Such change can be similarly applied to the control surface 17*b* formed on the transparent lens 12.

Also, in the above, such an example is illustrated that the control surfaces 17*b*, 17*d* are constructed by forming the groove portions 14*a*, 14*c* in the center portions 14, 14A respectively. In this case, the control surface can be formed as an outer surface of a projection portion that is provided to the center portion to project backward.

Figure 11:
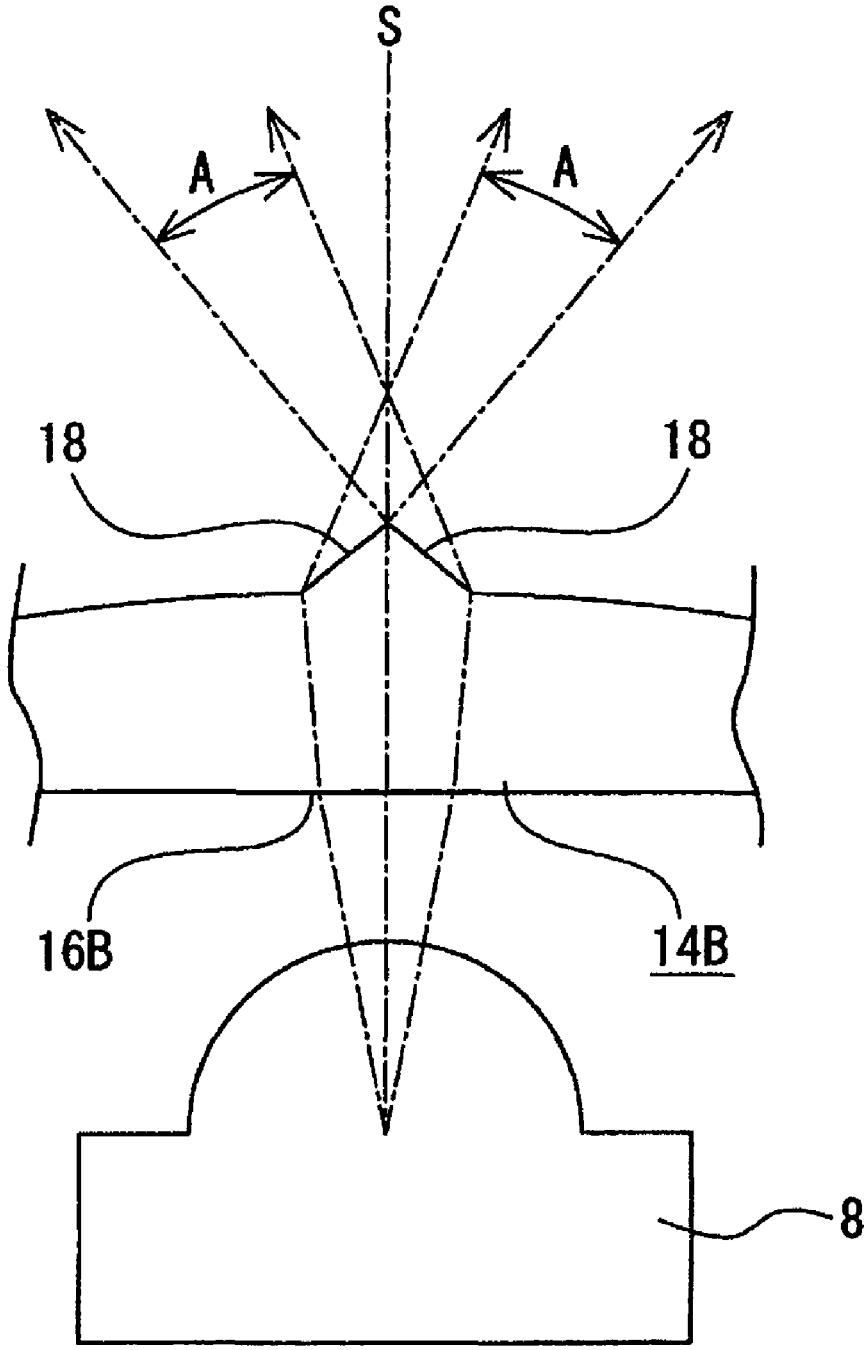
FIG. 11 is a conceptual view showing an example in which an outer surface of a conical projection portion provided to a center portion is set as a control surface.
Figure 12:
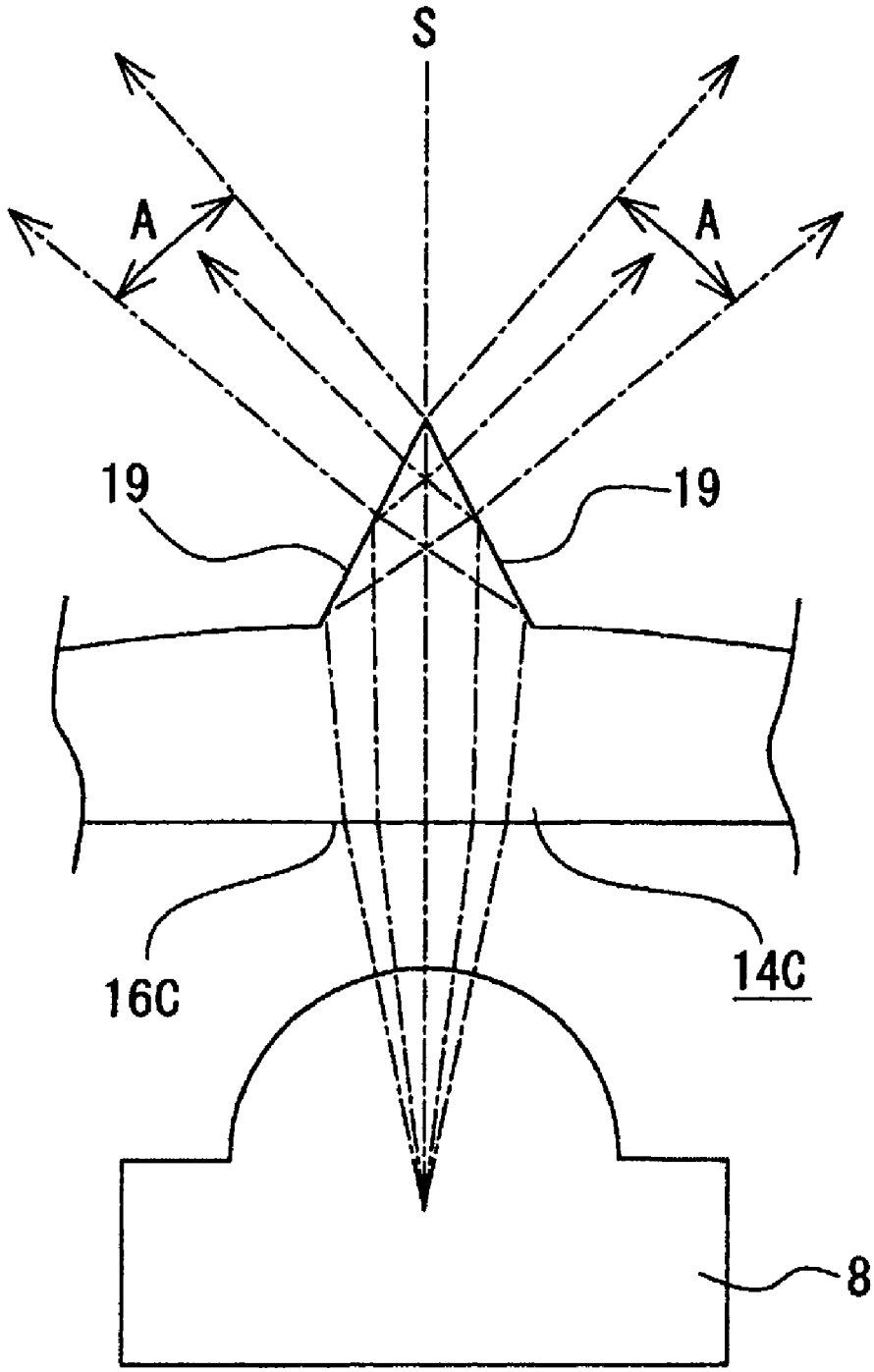
FIG. 12 is a conceptual view showing another example in which an outer surface of a conical projection portion provided to a center portion is set as a control surface.

A first example and a second example in which an outer surface of such projection portion is formed as the control surface respectively are shown here under (see FIG. 11 and FIG. 12).

The first example shows such an example that, as shown in FIG. 11, a conical projection portion 18 is provided in a center portion 14B, and an outer surface of the conical projection portion 18 is formed as a control surface 18*a*.

An emergent angle of the light that is incident on the conical projection portion 18 from an incident surface 16B of the center portion 14B is controlled by the control surface 18*a*, and then this light is emitted such that its emergent angle in the lateral direction with respect to the optical axis S is in a range of 25° to 50°. The light whose emergent angle is set in the range of 25° to 50° in the lateral direction arrives mainly at the portion of the light distributing area on the outer peripheral side in the lateral direction. In FIG. 11, the range A is contained in such a range that the emergent angle is set in the range of 25° to 50°.

The second example shows such an example that, as shown in FIG. 12, a conical projection portion 19 which amount of projection is set larger than that of the above conical projection portion 18 is provided to a center portion 14C, and an outer surface of the conical projection portion 19 is formed as a control surface 19*a*.

An emergent angle of the light that is incident on the conical projection portion 19 from an incident surface 16C of the center portion 14C is controlled by the control surface 19*a*, and then this light is emitted such that its emergent angle in the lateral direction with respect to the optical axis S is in a range of 25° to 50°. At this time, the light that is incident on the conical projection portion 19 from the incident surface 16C and arrives at the control surface 19*a* is internally reflected by the control surface 19*a*, and is emitted from another portion of the control surface 19*a*. The light whose emergent angle in the lateral direction is set to the range of 25° to 50° arrives mainly at the portion of the light distributing area on the outer peripheral side in the lateral direction. In FIG. 12, the range A is contained in such a range that the emergent angle is set in the range of 25° to 50°.

As described above, outer surfaces of the conical projection portions 18, 19 of the center portions 14B, 14C are formed as the control surfaces 18*a*, 19*a* respectively. Therefore, the emergent angle of the light can be controlled, and improvement in a margin of the control of light can be achieved.

Also, in the case where the outer surface of the projection portion is formed as the control surface, the control surface can be shaped into an outward convex or inward convex circular arc when viewed as a longitudinal sectional shape, like the case where the surface constituting the groove portion is used as the control surface. In this case, the case where the surface constituting the groove portion is formed as the control surface can contribute to a thickness reduction of the projection portion rather than the case where the outer surface of the projection portion is formed as the control surface.

While description has been made in connection with a specific exemplary embodiment of the invention and examples of variations thereof, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

1 vehicle lighting equipment, 8 light source, 12 transparent lens, 14 center portion, 14*a* groove portion, 15 light guiding portion, 15*b* second emergent surface, 16 incident surface, first emergent surface, 17*b* control surface, 12A transparent lens, 14A center portion, 14*c* groove portion, 15A light guiding portion, 15*f* second emergent surface, 16A incident surface, 17A first emergent surface, 17*d* control surface

What is claimed is:

1. A vehicle lighting equipment comprising:

a light source in which a light emitting diode is employed; and a transparent lens on which a light emitted from the light source is incident and from which the incident light is emergent, wherein the transparent lens includes a center portion positioned to oppose to the light source and a light guiding portion positioned on an outer peripheral side of the center portion to guide the incident light to an inward area, wherein the center portion includes an incident surface which opposes to the light source and on which the light emitted from the light source is incident, and a first emergent surface from which the light that is incident from the incident surface is emergent, wherein the light guiding portion includes a second emergent surface from which the light guided to the inward area is emergent, and wherein the first emergent surface of the center portion includes a control surface adapted to control the light such that an emergent angle in a horizontal direction is set to a range of 25° to 50° with respect to an optical axis.

2. The vehicle lighting equipment according to claim 1, wherein a recessed portion is formed on the center portion, and a surface constituting the recessed portion is formed as the control surface.

3. The vehicle lighting equipment according to claim 2, wherein the recessed portion has a conical shape whose diameter is decreased toward a bottom portion.

4. The vehicle lighting equipment according to claim 2, wherein the recessed portion is formed such that respective widths of an opening surface of the recessed portion in two directions that orthogonally intersect with the optical axis are different, and a bottom portion of the recessed portion is formed into a straight line that extends in a longitudinal direction of the opening surface.

5. The vehicle lighting equipment according to claim 1, wherein a projected portion is formed on the center portion, and a surface constituting the projected portion is formed as the control surface.

6. The vehicle lighting equipment according to claim 5, wherein the projected portion has a conical shape whose diameter is decreased toward a peak portion.

* * * * *